US008899195B2

(12) United States Patent
Woo et al.

(10) Patent No.: US 8,899,195 B2
(45) Date of Patent: Dec. 2, 2014

(54) ELECTRO-HYDRAULIC VARIABLE VALVE LIFT APPARATUS

(71) Applicant: Hyundai Motor Company, Seoul (KR)

(72) Inventors: Soo Hyung Woo, Yongin-si (KR); Byong Young Choi, Bucheon-si (KR); Young Hong Kwak, Suwon-si (KR); Jin Kook Kong, Suwon-si (KR); Wonjun Lee, Incheon (KR)

(73) Assignee: Hyundai Motor Company, Seoul (KR)

( * ) Notice: Subject to any disclaimer, the term of this patent is extended or adjusted under 35 U.S.C. 154(b) by 73 days.

(21) Appl. No.: 13/711,573

(22) Filed: Dec. 11, 2012

(65) Prior Publication Data

US 2014/0041605 A1 Feb. 13, 2014

(30) Foreign Application Priority Data

Aug. 8, 2012 (KR) ..... 10-2012-0086706

(51) Int. Cl.

| | |
|---|---|
| ***F01L 9/02*** | (2006.01) |
| ***F01L 1/34*** | (2006.01) |
| ***F01L 13/00*** | (2006.01) |
| *F01L 1/46* | (2006.01) |

(52) U.S. Cl.

CPC ..... *F01L 1/34* (2013.01); *F01L 13/0005* (2013.01); *F01L 9/025* (2013.01); *F01L 2013/001* (2013.01); *F01L 2001/467* (2013.01)

USPC ..... 123/90.12

(58) Field of Classification Search

CPC ..... F01L 9/025; F01L 9/023; F01L 9/021; F01L 9/02; F02M 59/102

USPC ..... 123/90.11, 90.12, 90.15, 90.16, 90.48

See application file for complete search history.

(56) References Cited

U.S. PATENT DOCUMENTS

| | | | | |
|---|---|---|---|---|
| 2006/0137634 | A1 * | 6/2006 | Vattaneo et al. | 123/90.12 |
| 2009/0308340 | A1 * | 12/2009 | Gecim et al. | 123/90.57 |
| 2010/0168987 | A1 * | 7/2010 | De Cristoforo et al. | 701/105 |

FOREIGN PATENT DOCUMENTS

| | | | |
|---|---|---|---|
| DE | 4124184 | A1 * | 1/1993 |
| JP | 07-259519 | A | 10/1995 |
| JP | 2009-121270 | A | 6/2009 |
| KR | 10-20120017982 | A | 2/2012 |

* cited by examiner

*Primary Examiner* — Thomas Denion
*Assistant Examiner* — Daniel Bernstein
(74) *Attorney, Agent, or Firm* — Morgan, Lewis & Bockius LLP

(57) ABSTRACT

An electro-hydraulic variable valve lift apparatus may include an hydraulic pump body installed in an engine, a piston provided to reciprocate within the hydraulic pump body and forming an hydraulic pump chamber together with the hydraulic pump body, an hydraulic pump cam disposed to be in contact with the piston and enabling the piston to reciprocate according to a rotation thereof, a retainer provided to be slidable along the piston between the piston and the engine and forming a retainer chamber with the engine, a retainer spring elastically supporting the retainer, an oil control valve allowing the hydraulic pump chamber and the retainer chamber to selectively communicate with each other, a valve opening and closing unit communicating with the hydraulic pump chamber and opened or closed according to oil pressure supplied from the hydraulic pump chamber.

9 Claims, 3 Drawing Sheets

ELECTRO-HYDRAULIC VARIABLE VALVE LIFT APPARATUS

CROSS-REFERENCE TO RELATED APPLICATION

The present application claims priority to Korean Patent Application No. 10-2012-0086706 filed on Aug. 8, 2012, the entire contents of which is incorporated herein for all purposes by this reference.

BACKGROUND OF THE INVENTION

1. Field of the Invention

The present invention relates to an electro-hydraulic variable valve lift apparatus and, more particularly, to an electro-hydraulic variable valve lift apparatus adaptive to have a simplified oil circuit to reduce oil flow path resistance.

2. Description of Related Art

An internal combustion engine takes in fuel and air to a combustion chamber and burns the same to generate power. In case of sucking air, an intake valve is operated by driving a cam shaft, and while the intake valve is open, air is sucked into the combustion chamber. Also, an exhaust valve is operated by driving the cam shaft, and while the exhaust valve is open, air is expelled from the combustion chamber.

However, an optimal operation of the intake valve and the exhaust valve varies according to a rotation speed of an engine. Namely, an appropriate lift or valve opening/closing time varies according to a rotation speed of an engine. Thus, in order to implement an appropriate valve operation according to a rotation speed of an engine, a plurality of cams for driving valves are designed, or a variable valve lift (VVL) apparatus in which a valve is operated at a different lift according to an engine RPM, a variable valve timing (VVT), an electro-hydro valve lift (EHV), and the like, have been searched.

In case of a generally used EHV apparatus, an oil circuit for an operation thereof is complicated and resistance of oil that passes through the complicated oil circuit is problematic.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an electro-hydraulic variable valve lift apparatus adaptive to have a simplified oil circuit to reduce oil flow path resistance.

In an aspect of the present invention, an electro-hydraulic variable valve lift apparatus may include a hydraulic pump body installed in an engine, a piston slidably provided in the hydraulic pump body to reciprocate therein and forming an hydraulic pump chamber together with the hydraulic pump body, an hydraulic pump cam disposed to be in contact with the piston and enabling the piston to reciprocate according to a rotation of the hydraulic pump cam, a retainer provided in the engine to be slidable along a longitudinal direction of the piston between the piston and the engine and forming a retainer chamber with the engine, a retainer spring elastically supporting the retainer, an oil control valve selectively allowing the hydraulic pump chamber and the retainer chamber to fluid-communicate with each other, and a valve opening and closing unit fluid-communicating with the hydraulic pump chamber and opened or closed according to oil pressure supplied from the hydraulic pump chamber thereto.

The retainer spring is brought into contact with the retainer and the piston to provide elastic force to the piston.

The hydraulic pump body may include a retainer hole fluid-communicating the hydraulic pump chamber with the retainer chamber, wherein the oil control valve may include an operational rod slidably mounted in the retainer chamber and selectively opens or closes the retainer hole through operation of the operational rod.

The electro-hydraulic variable valve lift apparatus may further may include an oil supply line connected to the hydraulic pump chamber and supplying oil thereto, and a check valve provided in the oil supply line.

The electro-hydraulic variable valve lift apparatus may further may include an operation line fluid-connecting the hydraulic pump chamber to the valve opening and closing unit.

The oil supply line is fluid-connected to the operation line.

The electro-hydraulic variable valve lift apparatus may further may include a piston spring provided between the piston and the hydraulic pump body in the hydraulic pump chamber to elastically support the piston.

The oil control valve implements a high lift mode by preventing the oil pressure from being released from the hydraulic pump chamber to the retainer chamber during a cycle in which the valve opening and closing unit is opened or closed.

The oil control valve implements a low lift mode by allowing the hydraulic pump chamber and the retainer chamber to be fluid-connected while the piston is lowered.

The oil control valve implements a cylinder deactivation mode by allowing the hydraulic pump chamber and the retainer chamber to be constantly fluid-connected.

In the case of the electro-hydraulic variable valve lift apparatus according to an exemplary embodiment of the present invention, oil flow path resistance can be reduced by simplifying an oil circuit.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
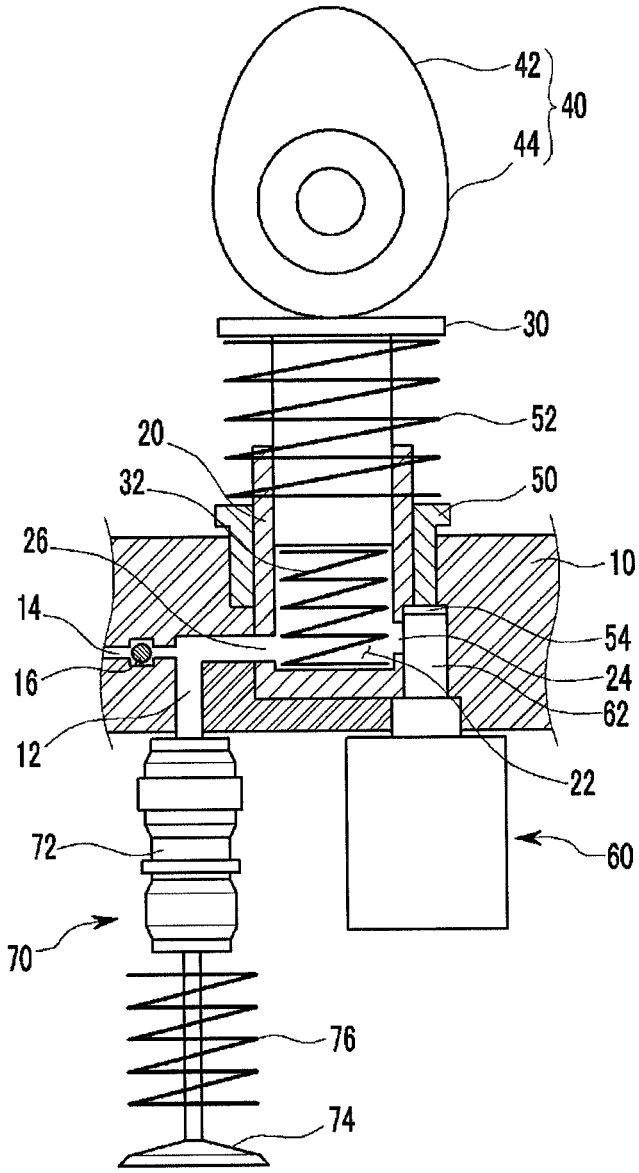
FIG. 1 is a sectional view of an electro-hydraulic variable valve lift apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

The present invention will be described more fully hereinafter with reference to the accompanying drawings, in which exemplary embodiments of the invention are shown As those skilled in the art would realize, the described embodiments may be modified in various different ways, all without departing from the spirit or scope of the present invention Throughout the specification, unless explicitly described to the contrary, the word "include" and variations such as "includes" or "including", will be understood to imply the inclusion of stated elements but not the exclusion of any other elements.

Throughout the specification, components denoted by the same reference numerals are the same components.

In the drawings, the thickness of layers, films, panels, regions, etc., are exaggerated for clarity.

FIG. 1 is a sectional view of an electro-hydraulic variable valve lift apparatus according to an exemplary embodiment of the present invention.

An electro-hydraulic variable valve lift apparatus according to an exemplary embodiment of the present invention includes, an hydraulic pump body 20 installed in an engine 10, a piston 30 provided to reciprocate within the hydraulic pump body 20 and forming an hydraulic pump chamber 22 together with the hydraulic pump body 20, an hydraulic pump cam 40 disposed to be in contact with the piston 30 and enabling the piston 30 to reciprocate according to a rotation thereof, a retainer 50 provided to be slidable along the piston 30 between the piston 30 and the engine 10 and forming a retainer chamber 54 with the engine 10, a retainer spring 52 elastically supporting the retainer 50, an oil control valve 60 allowing the hydraulic pump chamber 22 and the retainer chamber 54 to selectively communicate with each other, a valve opening and closing unit 70 communicating with the hydraulic pump chamber 22 and opened or closed according to oil pressure supplied from the hydraulic pump chamber 22.

Here, the engine 10 may have a concept of including a cylinder head, a valve train, and the like.

The retainer spring 52 may be brought into contact with the piston 30 and the retainer 50 to provide elastic force.

Namely, the retainer spring 52 may be interposed between the piston 30 and the retainer 50 and provide elastic force to the piston 30 and the retainer 50.

Also, the electro-hydraulic variable valve lift apparatus according to an exemplary embodiment of the present invention may further include a piston spring 32 provided between the piston 30 and the hydraulic pump body 20 to elastically support the piston 30.

Namely, the retainer spring 52 may be interposed between the piston 30 and the retainer 50 to provide elastic force to the piston 30 and the retainer 50, or another piston spring 32 may be provided to elastically support the piston 30.

The hydraulic pump body 20 includes a retainer hole 24 communicating with the retainer chamber 54, and the oil control valve 60 may include an operation rod 62 and selectively open and close the retainer hole 24 through the operation rod 62.

The electro-hydraulic variable valve lift apparatus according to an exemplary embodiment of the present invention may further include an oil supply line 14 supplying oil to the hydraulic pump chamber 22 and a check valve 16 provided in the oil supply line 14.

In the electro-hydraulic variable valve lift apparatus according to an exemplary embodiment of the present invention, oil may be leaked during an operation process of the electro-hydraulic variable valve lift apparatus, and oil supplied from an oil supply unit may be supplied to the hydraulic pump chamber 22 through the oil supply line 14, whereby oil within the electro-hydraulic variable valve lift apparatus can be maintained at a predetermined level. Here, the check valve 16 prevents oil from flowing backward from the hydraulic pump chamber 22.

The valve opening and closing unit 70 may include a brake unit 72 implementing smooth opening and closing of a valve profile in a start position and an end position of the valve profile, a valve 74 opened or closed according to oil pressure supplied from the hydraulic pump chamber 22, and a valve spring 76 elastically supporting the valve 74.

When high pressure is formed within the hydraulic pump chamber 22 according to an operation of the hydraulic pump cam 40, the high pressure oil operates the valve 74 through an operation hole 26 formed in the hydraulic pump body 20 and an operation line 12 to open the valve 74.

Here, the operation and configuration of the brake unit 72, the valve 74, and the valve spring 76 are obvious to a person skilled in the art, so a detailed description thereof will be omitted.

Figure 2:
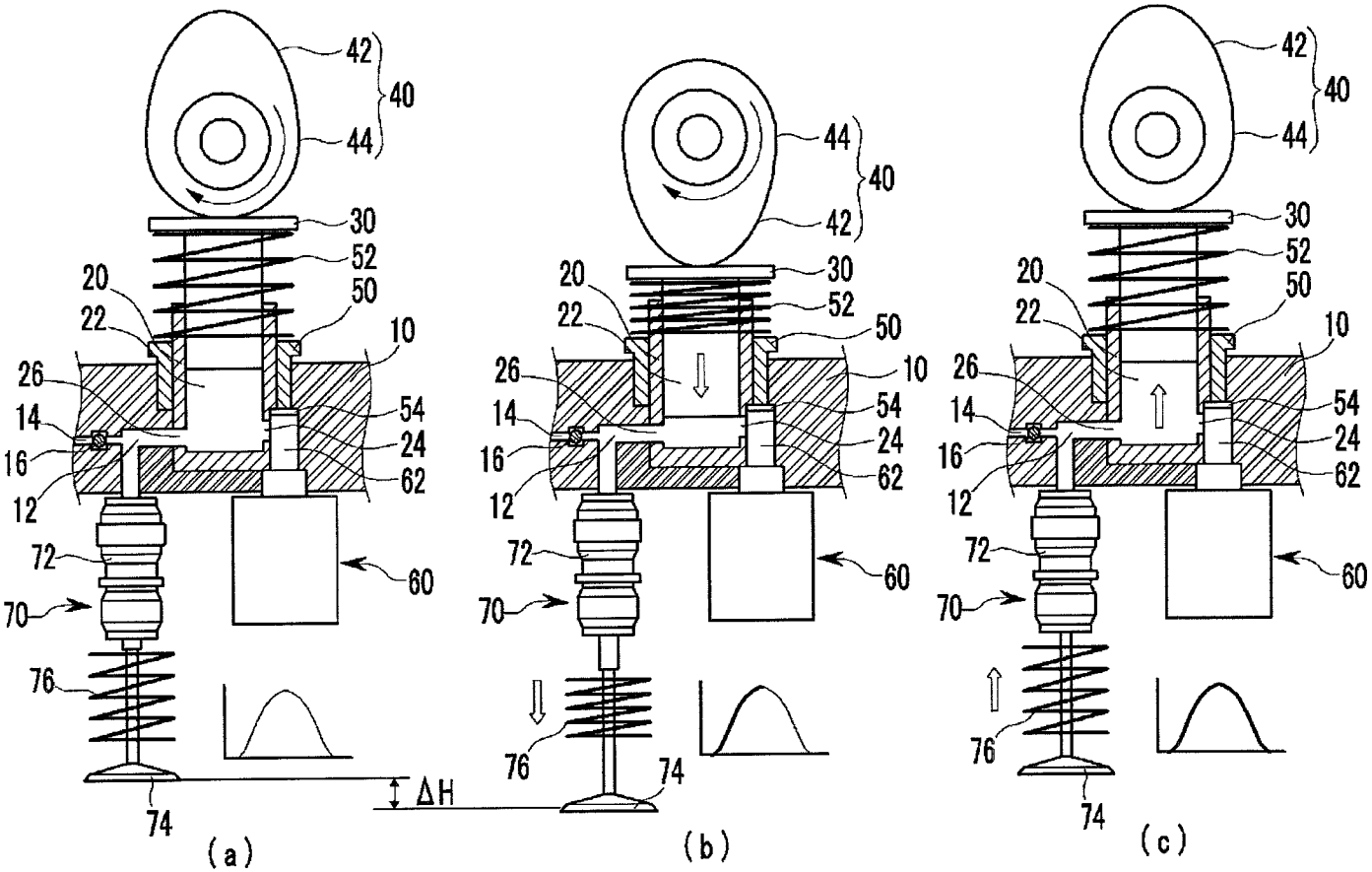
FIGS. 2(*a*), 2(*b*) and 2(*c*) are views illustrating an operation of the electro-hydraulic variable valve lift apparatus in a high lift mode according to an exemplary embodiment of the present invention.
Figure 3:
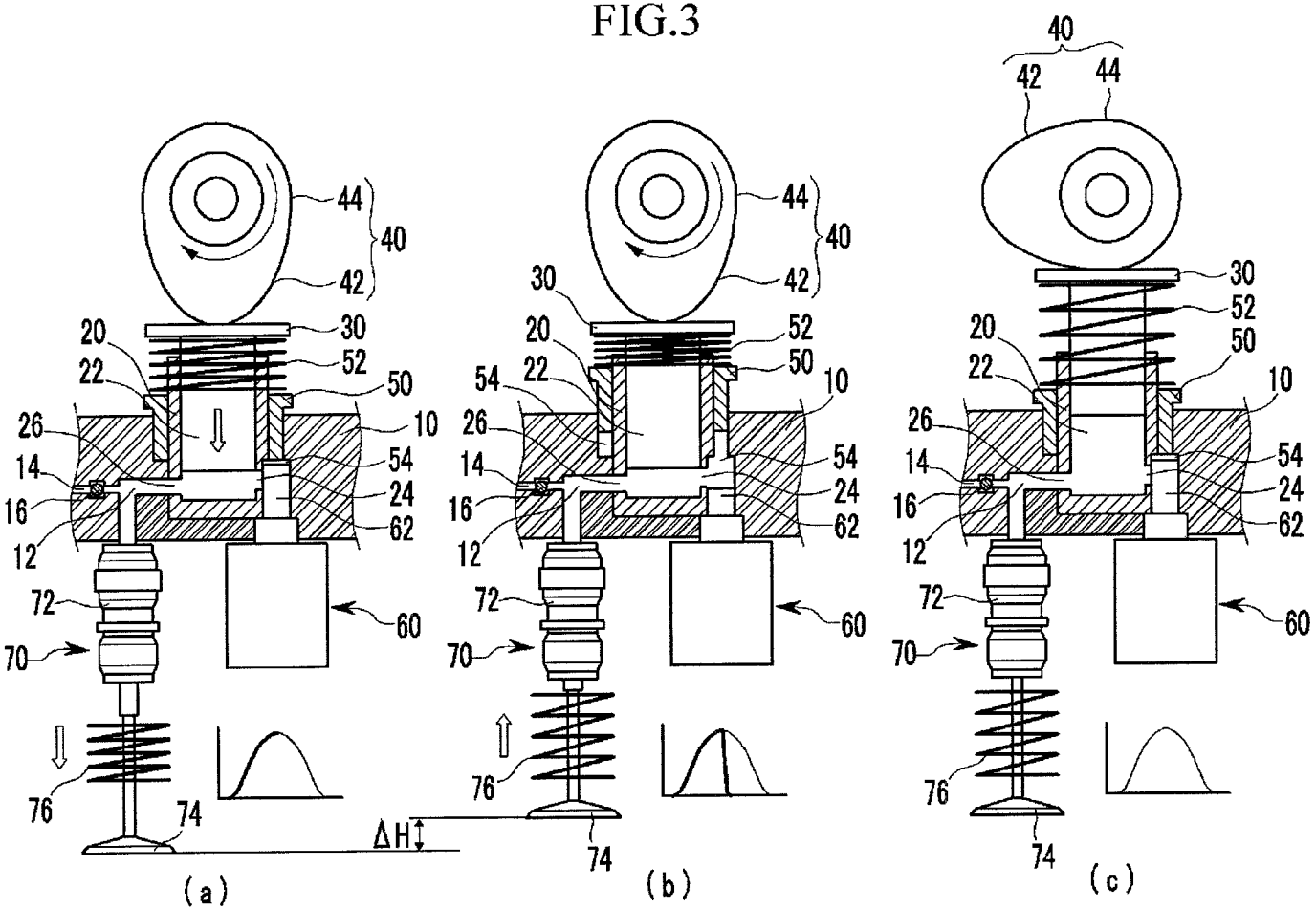
FIGS. 3(*a*), 3(*b*) and 3(*c*) are views illustrating an operation of the electro-hydraulic variable valve lift apparatus in a low lift mode according to an exemplary embodiment of the present invention.

FIGS. 2(*a*), 2(*b*) and 2(*c*) are views illustrating an operation of the electro-hydraulic variable valve lift apparatus in a high lift mode according to an exemplary embodiment of the present invention, and FIGS. 3(*a*), 3(*b*) and 3(*c*) are views illustrating an operation of the electro-hydraulic variable valve lift apparatus in a low lift mode according to an exemplary embodiment of the present invention.

Hereinafter, an operation of the electro-hydraulic variable valve lift apparatus according to an exemplary embodiment of the present invention will be described with reference to the figures.

Referring to FIGS. 2(*a*)-(*c*), in the high lift mode, the oil control valve 60 prevents oil pressure from being released from the hydraulic pump chamber 22 to the retainer chamber 54 during a cycle in which the valve opening and closing unit 70 is opened or closed, thus implementing the high lift mode.

Namely, as illustrated in FIGS. 2(*a*) to 2(*c*), the valve 74 is opened or closed by forming the same profile as that of a general valve lift apparatus according to a rotation of the hydraulic pump cam 40. Here, the operation rod 62 of the oil control valve 60 is maintained to close the retainer hole 24.

Referring to FIGS. 3(*a*)-(*c*), in the low lift mode, the oil control valve 60 allows the hydraulic pump chamber 22 and the retainer chamber 54 to communicate with each other while the piston 30 is being lowered, thus implementing the low lift mode.

Namely, as illustrated in FIG. 3(*a*) and FIG. 3(*b*), in a state in which a cam lobe 42 of the hydraulic pump cam 40 presses the piston 30, the oil control valve 60 operates to make the operation rod 60 open the retainer hole 24. Then, the high pressure fluid within the hydraulic pump chamber 22 is introduced into the retainer chamber 54 to make the retainer 50 slide in an upward direction of the drawing along the hydraulic pump body 20. Then, a relative volume of the retainer chamber 54 is increased, and accordingly, the oil, which has been supplied to the valve opening and closing unit 70, is partially released to the retainer chamber 54.

Thus, as illustrated in FIG. 3(*b*), the valve 74 is closed, forming the profile illustrated in the graph. Namely, the low lift mode is implemented.

Thereafter, as illustrated in FIG. 3(*c*), when the hydraulic pump cam 40 is rotated, a cam base circle 44 and the piston 30 come into contact with each other, and the piston 30 is lifted by elastic force of the retainer spring 52 or the piston spring 32, while the retainer 50 is lowered by elastic force of the retainer spring 52.

Then, the oil within the retainer chamber 54 is introduced again into the hydraulic pump chamber 22 and the operation rod 62 closes the retainer hole 24, entering a preparation stage for implementing a next cycle.

Here, the operation of the oil control valve 60 in the rotation position of the hydraulic pump cam 40 as illustrated in FIG. 3(*c*) is an exemplary embodiment of the operation of the low lift mode of the electro-hydraulic variable valve lift apparatus according to an exemplary embodiment of the present invention, and the oil control valve 60 may operate according to various rotational positions of the hydraulic pump cam 40 under the control of an engine control unit (ECU) to form various valve profiles.

The oil control valve 60 may allow the oil pump chamber 22 and the retainer chamber 54 to constantly communicate with each other, regardless of a rotational position of the hydraulic pump cam 40, to implement a cylinder deactivation (CDA) mode.

Namely, when the operation rod 62 maintains an open state, the retainer 60 reciprocate vertically according to a rotation of the hydraulic pump cam 40. However, since oil is not supplied to the valve opening and closing unit 70, the valve 74 is not opened or closed.

As described above, in the case of the electro-hydraulic variable valve lift apparatus according to an exemplary embodiment of the present invention, the oil circuit can be simplified, thus reducing oil flow path resistance. Also, the simple structure improves hydraulic efficiency and reduces driving friction.

Also, referring to FIG. 3, in the operational process from FIG. 3(*a*) to FIG. 3(*b*), the retainer spring 52 is compressed according to a rotation of the hydraulic pump cam 40, and thereafter, it is compressed according to a movement of the retainer 50. Thereafter, in the operational process from FIG. 3(*b*) to FIG. 3(*c*), the retainer spring 52 expands to rotate the hydraulic pump cam 40, so an effect of reducing energy for rotating the hydraulic pump cam 40 can be obtained.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An electro-hydraulic variable valve lift apparatus comprising:

a hydraulic pump body installed in an engine;

a piston slidably provided in the hydraulic pump body to reciprocate therein and forming a hydraulic pump chamber together with the hydraulic pump body;

a hydraulic pump cam disposed to be in contact with the piston and enabling the piston to reciprocate according to a rotation of the hydraulic pump cam;

a retainer provided in the engine to be slidable along a longitudinal direction of the piston between the piston and the en line and form a retainer chamber with the engine;

a retainer spring elastically supporting the retainer;

an oil control valve selectively allowing the hydraulic pump chamber and the retainer chamber to fluid-communicate with each other; and a valve opening and closing unit fluid-communicating with the hydraulic pump chamber and opened or closed according to oil pressure supplied from the hydraulic pump chamber thereto;

wherein the retainer spring is brought into contact with the retainer and the piston to provide elastic force to the piston;

wherein the hydraulic pump body includes a retainer hole fluid-communicating the hydraulic pump chamber with the retainer chamber, and wherein the oil control valve includes an operational rod slidably mounted in the retainer chamber and selectively opens or closes the retainer hole through operation of the operational rod.

2. The electro-hydraulic variable valve lift apparatus of claim 1, further including:

an oil supply line connected to the hydraulic pump chamber and supplying oil thereto; and a check valve provided in the oil supply line.

3. The electro-hydraulic variable valve lift apparatus of claim 2, further including an operation line fluid-connecting the hydraulic pump chamber to the valve opening and closing unit.

4. The electro-hydraulic variable valve lift apparatus of claim 2, wherein the oil supply line is fluid-connected to the operation line.

5. The electro-hydraulic variable valve lift apparatus of claim 1, further including:

a piston spring provided between the piston and the hydraulic pump body in the hydraulic pump chamber to elastically support the piston.

6. The electro-hydraulic variable valve lift apparatus of claim 1, wherein the oil control valve implements a high lift mode by preventing the oil pressure from being released from the hydraulic pump chamber to the retainer chamber during a cycle in which the valve opening and closing unit is opened or closed.

7. The electro-hydraulic variable valve lift apparatus of claim 1, wherein the oil control valve implements a low lift mode by allowing the hydraulic pump chamber and the retainer chamber to be fluid-connected while the piston is lowered.

8. The electro-hydraulic variable valve lift apparatus of claim 1, wherein the oil control valve implements a cylinder deactivation mode by allowing the hydraulic pump chamber and the retainer chamber to be constantly fluid-connected.

9. A vehicle having the electro-hydraulic variable valve lift apparatus according to claim 1.

* * * * *